US007266320B2

(12) United States Patent
Litwiller

(10) Patent No.: US 7,266,320 B2
(45) Date of Patent: Sep. 4, 2007

(54) AUTOMATED DUPLEX PRINTING OF HEAVYWEIGHT SHEETS IN SPECIAL SIMPLEX MODE

(75) Inventor: Debora Margaret Hejza Litwiller, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 233 days.

(21) Appl. No.: 11/221,070

(22) Filed: Sep. 7, 2005

(65) Prior Publication Data

US 2007/0053711 A1 Mar. 8, 2007

(51) Int. Cl.
*G03G 15/00* (2006.01)

(52) U.S. Cl. ..... 399/85; 399/45; 399/401

(58) Field of Classification Search ..... 399/8, 399/364, 401, 402, 45, 82, 85
See application file for complete search history.

(56) References Cited

U.S. PATENT DOCUMENTS

| | | | | |
|---|---|---|---|---|
| 3,603,680 | A | 9/1971 | Barton | |
| 3,627,311 | A | 12/1971 | Spinelli | |
| 5,172,162 | A * | 12/1992 | Taneda | 399/85 |
| 5,982,996 | A | 11/1999 | Snyders | |
| 6,018,398 | A | 1/2000 | Bunker | |
| 6,581,456 | B1 | 6/2003 | Clark | |
| 6,676,309 | B2 | 1/2004 | Shima | |
| 6,762,852 | B1 | 7/2004 | Fischer | |
| 2003/0043398 | A1 | 3/2003 | Dabney et al. | |
| 2003/0053816 | A1 * | 3/2003 | Asai | 399/82 |

OTHER PUBLICATIONS

U.S. Appl. No. 10/871,318, filed Jun. 18, 2004 by David L. Knierim, entitled "Print Media Thickness Measurement System".
"Xerox Disclosure Journal" publication of Mar./Apr. 1983, vol. 8, No. 2, pp. 163-164 by Raymond W. Huggins entitled "Paper Presence and Size Detector."

* cited by examiner

*Primary Examiner*—Susan Lee
(74) *Attorney, Agent, or Firm*—James J. Ralabate; Paul F. Morgan

(57) ABSTRACT

In a duplex printer with automatic duplex printing by recirculating the sheets printed on their first sides through a duplex path for printing their second sides before feeding them to the output path, electronic information corresponding to a pre-set maximum level of acceptable sheet weight for that printer is compared to a remote user job input with electronic information corresponding to the desired sheets to be printed. If exceeded, the printer automatically switches to a different duplex printing mode in which the heavyweight sheets are printed on only one side and fed to the output path, and a GUI at the printer automatically displays instructions to unload these simplex printed sheets and properly reload them in an input in the correct orientation to print their opposite sides with locally stored page images for those opposite sides, and printing is restarted at the printer rather than the remote job input site.

8 Claims, 2 Drawing Sheets

AUTOMATED DUPLEX PRINTING OF HEAVYWEIGHT SHEETS IN SPECIAL SIMPLEX MODE

Figure 1:
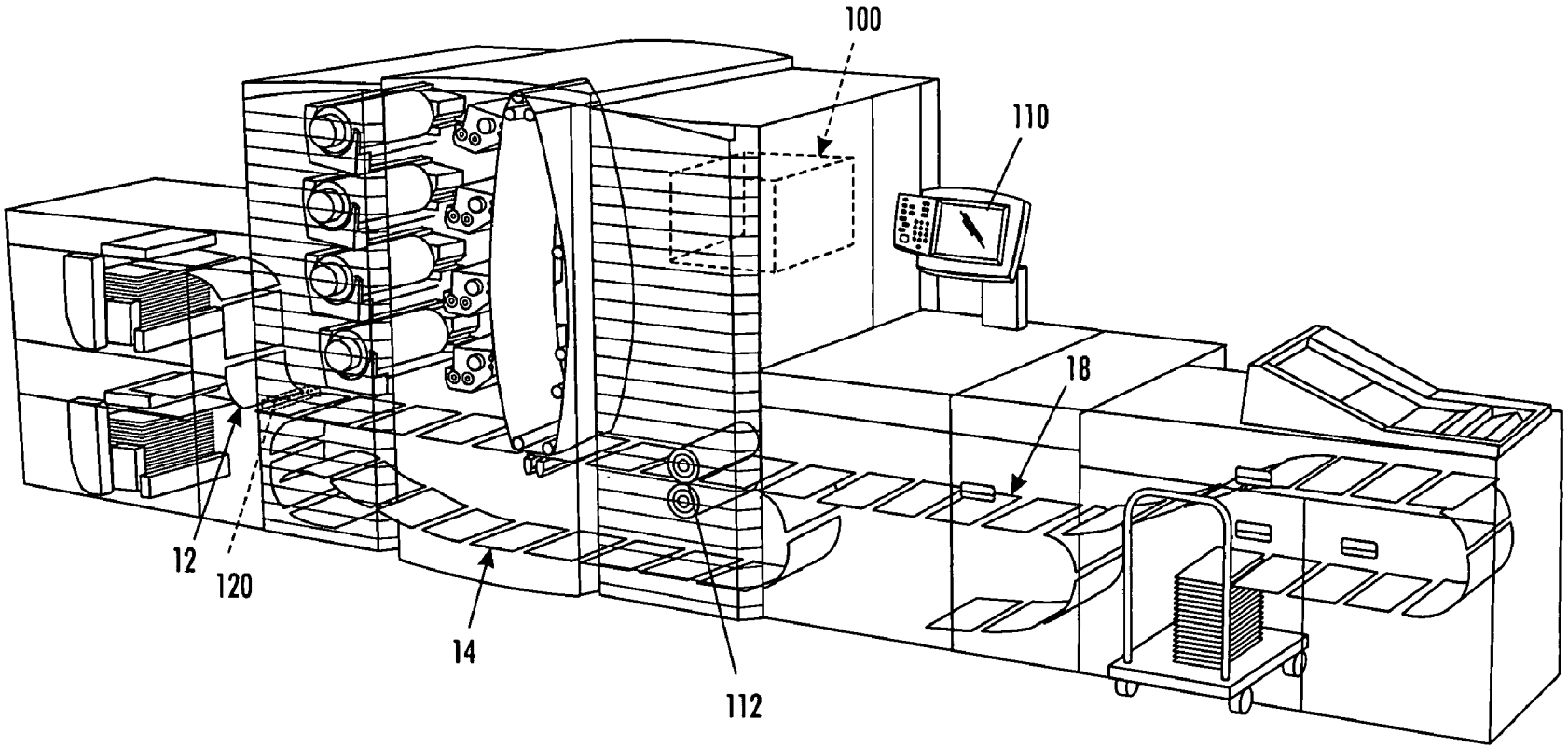

Disclosed in the embodiment herein is a dual mode system or method of improved duplex printing of heavyweight sheets on a centralized or shared printer being sent print jobs from remote user PCs. Such as, but not limited to, a xerographic duplex electronic printer with a normal duplex printing system comprising an inverter and duplex loop paper path where heavyweight paper sheets could have an excessive jam rate or other difficulties in printing by the normal duplex mode of operation of the printer, due to arcuate (non-linear) bends in such normal duplex printing paths, etc. Those heavyweight sheets (unlike normal print media sheets) are automatically not printed the normal printer duplex mode of operation. Instead, they are automatically duplex printed in a simplex split job printing mode in response to selected print media exceeding a preset acceptable print media weight or other such limitation of the particular printer to which that print job is being electronically transmitted. The dual mode printer software can automatically switch in that case to a special two-pass simplex mode of operation in which only the first side pages of that print job are printed on only one side of the excessively heavy sheets selected for that print job, and outputted, while the second side (alternating page) digital images are temporarily electronically stored until the user unloads the first-side printed sheets of that print job from the output tray of the printer and reloads those first-side printed sheets into a sheet input of the printer (such as a bypass tray) and actuates a command on a printer graphic user interface to simplex print the second sides of those sheets with the temporarily electronically stored second side pages, without the operator having to go back to his or her remote PC location to restart the printing of the second sides of that print job.

Of particular background interest to the subject application, as to duplex printing of sheets in a simplex-only printer by electronically separating opposite side page images (alternate page images) and simplex printing the sheets of a multi-page, multi-sheet, print job on one side in each of two simplex printing passes of the print job, is Xerox Corp. U.S. Pat. No. 6,018,398 issued Jan. 25, 2000 to Keith G. Bunker. Also of possible background interest regarding electronic print drivers and controls, etc, is Xerox Corp. U.S. Published Application No. 20030043398 A1, published Mar. 6, 2003 and its cited U.S. patents, such as, U.S. Pat. No. 6,676,309 B2 issued Jan. 13, 2004; U.S. Pat. No. 6,762,852 B1 issued Jul. 13, 2004; and U.S. Pat. No. 5,982,996 issued Nov. 9, 1999.

By way of further background, numerous examples of xerographic and other duplex printing systems are known in the art and need not be described herein. Also by way of more specific background it is known to have operator manual entry of paper basis weight information into a printer controller.

It is also known to have in-line sensors in printers for detecting certain properties of sheets as they are being fed, such as various sheet thickness detectors or sensing the level of beam strength of a sheet acting against a baffle or other sensor in an arcuate section of a paper path. E.g., Xerox Corp. U.S. Pat. No. 6,581,456 issued Jun. 24, 2003 by Robert Clark, entitled "Substrate Bending Stiffness Measurement Method And System;" and allowed Xerox Corp. U.S. application Ser. No. 10/871,318 filed Jun. 18, 2004 by David L. Knierim, entitled "Print Media Thickness Measurement System".

As noted in said prior allowed application, various other types of print media sheet presence detection or thickness measurement systems, or similar double sheet feed detectors of overlapping sheets, have been proposed in or used in the art over many years using various technologies: pressure sensitive, acoustic, infra-red, pneumatic, piezoelectric, electrical conductivity, etc. The following patent disclosures are noted merely by way of some early examples: Xerox Corp. U.S. Pat. Nos. 3,603,680 and 3,627,311. Also noted is a "Xerox Disclosure Journal" publication of March/April 1983, Vol. 8, No. 2, pp. 163-164 by Raymond W. Huggins entitled "Paper Presence and Size Detector." As also noted in that prior allowed application, some printer products have installed automatic print media thickness sensing systems for improved user convenience and printing quality. One example is the OMRON™ Z4D-A01 reflective displacement sensor. As understood, it uses optical triangulation to measure distance. Distance is measured to a roller or backing surface, then the distance is measured again to the print media as it passes over the roller or backing surface.

By way of further background, it is well known in the art that many printers do not work as well on thick print media as they do on normal thickness paper without changing some known printing process parameters, such as image transfer current, fusing temperatures, etc. Normal print media sheets can be approximately 0.07 to 0.13 mm thick, for example, while thick print media sheets can be 0.20 mm or more thick, for example, and are typically thus much stiffer (having higher beam strength resistance to curvature). Thus, some printers have required the customer (user) to specify (and thus activate programming of parameter changes) media thickness (thick or normal media) via the machine's graphic user interface, control panel or job ticket after loading print media into a selected sheet feed tray or drawer. The consequence of not specifying thick media may be poor print quality or even worse problems. For example, undetected and un-programmed thick media may cause jams in a transfix nip instead of, or in addition to, poor print quality. This is unacceptable to the customer. Yet customers sometimes even forget to program in their change in the print media they have selected to be fed for printing a particular print job. Especially intermixed print jobs, such as normal basis weight paper being printed along with the intermittent printing of heavier card stock being printed for covers, insert transparencies, etc. Thus, some form of fully automatic, rather than manual user entry, print media thickness detection and handing can be desirable for various printers.

A specific feature of the specific embodiment disclosed herein is to provide a dual mode printing method for duplex printing of a print job onto print media sheets in a duplex printer having a sheet input, a duplex sheet recirculation path and a printed sheets output path, wherein the print job is being sent to the printer electronically from a remote user terminal, and wherein said print job contains print media sheet selection information, wherein said duplex printing of print media sheets has a normal first mode of duplex printing by recirculating said print media sheets after they are printed on their first sides through said printer duplex path of the printer for printing their second sides in said printer before feeding said print media sheets to said printed sheets output path, wherein said printer further includes a graphic user interface, a controller, and stored electronic information corresponding to pre-set print media sheet selections for which said normal first mode of duplex printing of print media sheets is undesirable for that printer, wherein, in response said receipt by said printer of a print job from said remote user terminal with said print media selection information corresponding to said pre-set print media sheet selections for which said normal first mode of duplex printing of print media sheets is undesirable for said printer, said printer automatically switches to a second and different mode of duplex printing in which said print media sheets are fed from said sheet input and printed on only one side and fed to said printed sheets output path bypassing said duplex sheet recirculation path and the portion of the print job for printing the other side of those print media sheets is temporarily stored in said printer controller and said printer graphic user interface automatically displays instructions to unload said printed sheets from said printed sheet output path and reload said printed sheets in said sheet input path in the proper orientation to print their opposite sides and the printing of said opposite sides is initiated from said printer graphic user interface rather than from said remote user terminal.

Further specific features disclosed in the embodiment herein, individually or in combination, include those wherein said printer graphic user interface automatically displays instructions to select said identified portion of said print job for second side printing from a displayed and tagged print job queue that corresponds to said opposite sides of said print media sheets that are printed on only one side; and/or wherein said remote user electronically sent print media selection information corresponding to said pre-set print media sheet selections for which said normal first mode of duplex printing of print media sheets is undesirable for said printer comprise a selection of a heavy-weight paper for a print job; and/or wherein said pre-set print media sheet selections for which said normal first mode of duplex printing of print media sheets is undesirable for said printer comprises print media sheets basis weight related information, and wherein print media sheets basis weight information for the print media sheets presently loaded into the sheet input of said printer is additionally provided by an in-line sensor in said sheet input; and/or a duplex printer having a sheet input, a duplex sheet recirculation path and a printed sheets output path, and a dual mode duplex printing system for duplex printing of print media sheets, wherein said duplex printer has a normal first mode of duplex printing in which said print media sheets are printed on their first sides and then fed through said printer duplex sheet recirculation path for printing their second sides in said printer before feeding said print media sheets to said printed sheets output path, wherein said printer further includes a graphic user interface and a controller in which is stored electronic information corresponding to a pre-set maximum print media sheet weight for which said normal first mode of duplex printing is allowed for that printer, and an input for electronic information from a remote source corresponding to the desired weight of print media sheets selected for printing of a particular print job by a remote user, wherein in response said input of electronic information from said remote source corresponding to the a desired weight of print media sheets which exceeds said pre-set level of maximum print media sheet weight, said printer automatically switches to a second and different mode of duplex printing in which said print media sheets are fed from said sheet input and printed on only one side and fed to said printed sheets output path bypassing said duplex sheet recirculation path, and said printer graphic user interface automatically displays instructions to unload said printed sheets from said printed sheet output path and reload said printed sheets in said sheet input path to print their second sides, and the printing of said second sides by said printer may be fully initiated from said printer graphic user interface without requiring any electronic signals from any remote location; and/or wherein said graphic user interface automatically displays instructions to select a print job for said printing of said second sides from a displayed print job queue on said printer graphic user interface; and/or wherein said printer has an in-line sheet properties sensor in said sheet input providing additional electronic information corresponding the weight of print media sheets in said sheet input of said printer; and/or wherein said graphic user interface automatically displays instructions to unload the sheets printed on only one side and to reload them in the input path in the correct orientation to print their opposite sides with selected stored page images for their opposite sides stored in said printer controller.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior software and prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
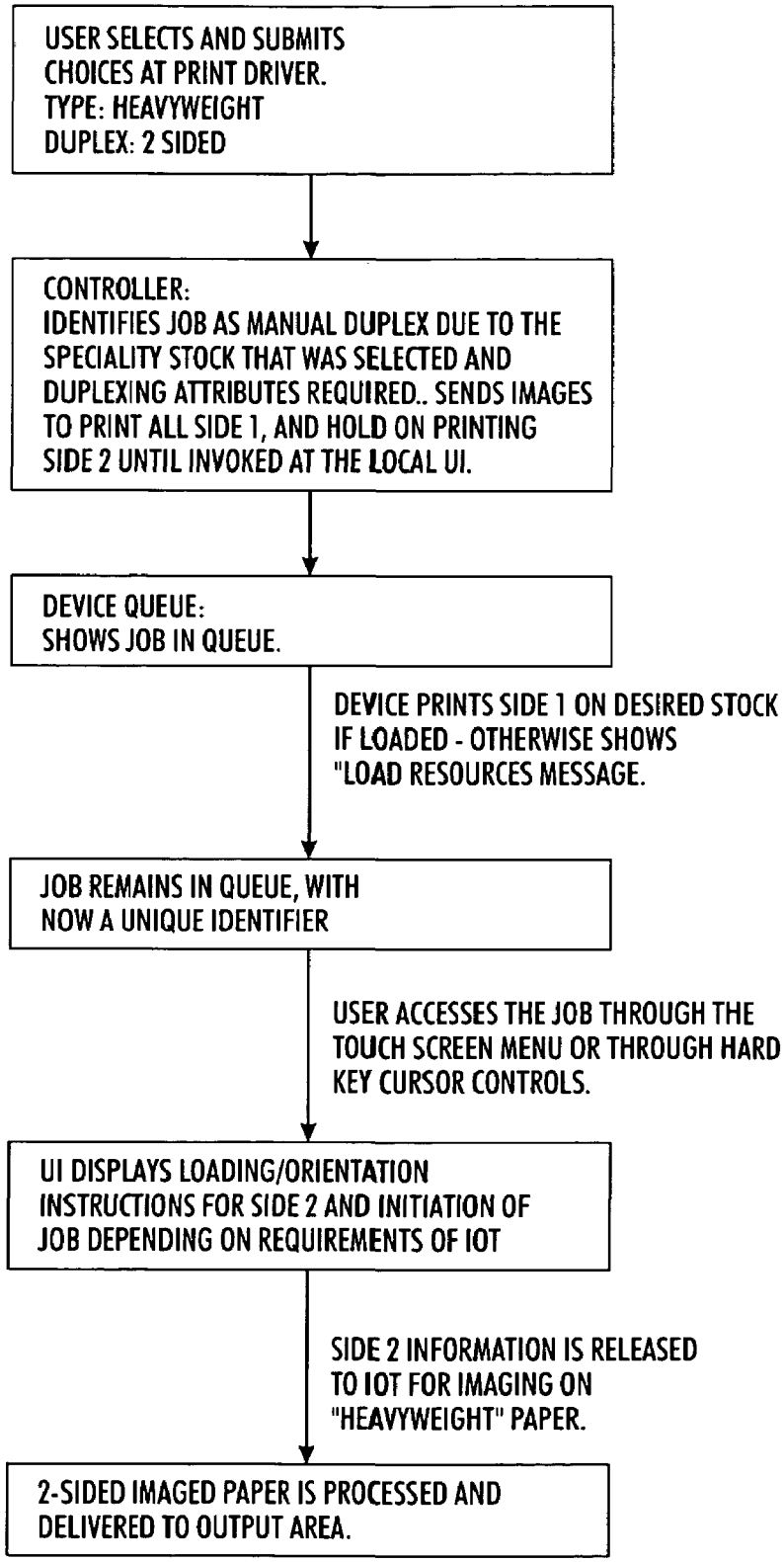

Various of the above-mentioned and further features and advantages will be apparent to those skilled in the art from the specific apparatus and its operation or methods described in the example below, and the claims. Thus, they will be better understood from this description of this specific embodiment, including the drawing figures (which are approximately to scale) wherein:

FIG. 1 schematically shows one example of a duplex printer in which the subject example of a dual mode duplex printing system may be utilized; and FIG. 2 is an exemplary flow chart, also illustrating some exemplary GUI instructions, for the example of FIG. 1.

FIG. 1 here illustrates one example of a well known modern xerographic duplex printer 10 with a print media sheet input path 12, duplex sheet recirculation loop 14 and sheet inverter 16 and an output path 18. The printer 10 is operated by one or more controllers 100. It also has one or more graphic user interfaces (GUI) 110 with displays controlled by the programmed controller 100, and selectable operator inputs controlling the controller 100 and thus the printer 10. An in-line sheet properties sensor 120 is also schematically disclosed in this example in the sheet input path 12. Since all of these components are well known to those skilled in the art and in published patents and other literature they need not be re-described in detail herein.

Disclosed in this embodiment is a system and method of simplifying a current approach for printing duplex heavyweight documents that can automatically avoid, and compensate for, practical restrictions in sending heavyweight paper through the duplex paper path of a duplex printer. Users who want to print duplex images on heavyweight stock must now often print them simplex, then use the bypass input tray to image the second side in order to avoid the duplex paper path restrictions of a duplex printer. Issues with this approach may include ensuring correct orientation of the paper for the second pass simplex printing in the bypass tray, as well as confusion with other print jobs in the print queue using the same resources, for example the bypass tray, while the user goes back to his remote PC to send the side two (second side) images to be printed.

When an excessively heavyweight print media duplex job is selected by the shared printer user on his or her remote PC or other such print driver interface source, it is known that the print job may be automatically split into two simplex jobs by software in the selected printer. The first split simplex job may be run normally, The second split simplex job that was heretofore held at the remote PC until the user released it in many prior systems is hereby sent to and held in printer associated memory. The local graphic user interface (GUI) 110 associate with the printer, via a "wizard" or other display, can instruct the user at the printer itself how to properly reload in the proper orientation the bypass tray with the sheets printed on only one side and then to release the job at the printer from that same GUI 110 to complete the duplex printing (printing the second sides of the reloaded sheets) without returning to the users remote terminal. With the disclosed system the user does not have to run back to his or her remote print driver print job sending terminal (typically a PC) to release the side two split simplex print job to the printer, and can avoid printer use interruptions by other users.

In other words, any printer users who want to print two-sided images on heavyweight stock are now burdened with having to manually duplex due to the restrictions of sending heavyweight paper through the duplex paper path, especially because of the sheet bending radii in the typical duplex paper path being resisted by the high beam strength of heavyweight paper sheets. Printing of heavyweight stock is preferably by a bypass paper path which provides a substantially "straight through" feeding of paper through the printer, but typically that path does not support automatic duplexing. But in that mode the user in many present systems is required to manually reload the side one printed sheets and then go back to the remote print driver, select "heavyweight Side 2" and resend side 2 images. During this procedure, the user is also at risk of reloading the imaged stock incorrectly, and not having the correct outcome. Instructions for reloading the simplex split print job sheets may not given at the local (printer) UI for this job requirement.

This system helps to solve the above and other problems by simplifying the controls in the remote print driver by eliminating the necessity for "heavyweight Side 2" selection in the remote print driver UI. The user is further assisted by a wizard type dialogue at the local GUI 110 that steps the user through the process of completing this manual duplex print job. For example:

At the remote print driver:

User selects desired paper stock (heavyweight or other stock that cannot be run through the duplex path).

User selects duplex setting (2 Sided).

User submits print job.

Print controller automatically sends the print job for that paper stock into two separated sub-jobs—all side 1's and all side 2's.

At the printer:

The printer prints all the first sides on the desired stock. During the first appearance in the job queue, the job need not have any GUI attention identifier attached, since the user is not required to take any action. After the side 1 imaging is completed, the side 2 print job remains in the print queue. The print job name/identifier now has a unique attention marker associated with it, indicating further action is required.

The user selects their job in the job queue from the printer GUI.

The printer GUI displays a "manual duplex wizard" that instructs the user how to reload paper correctly in the bypass tray with the correct orientation for receiving side 2.

The job is then released for printing side 2.

This exemplary process can be desirably further automated by automatic input of sheet weight information obtained directly, or by interpolation or comparison with a stored table of sheet thickness information in the controller 100, from an in-line sheet thickness sensor 120 schematically shown in the sheet input path. This may be, for example, one of the sheet thickness systems patents or applications described, cited and incorporated above, or a corresponding sheet beam strength sensor. That electrical signal measuring the input sheets properties can automatically trigger the switching to the second or dual-simplex mode of printing of sheets when such sheet weight sensor information signals exceed a pre-set maximum paper weight level without requiring any operator manual GUI entry of sheet weight information of sheets available in the printer, or any operator manual GUI selection of a heavyweight paper duplex printing two pass simplex printing mode. It will be understood by those skilled in this art that the terms sheet weight, basis weight, or corresponding sheet beam strength, may be used interchangeably for purposes of this application and are intended to cover one another in the accompanying claims unless indicated otherwise. The pre-set level of the particular print media weight for which automatic switching of the dual duplex printing mode to the two-pass simplex printing mode is desirable for that particular model duplex printer is desirably stored in the non-volatile memory of the controller 100 for that printer. That pre-set level will of course vary between different types of printers having different print media handling capabilities.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A dual mode printing method for duplex printing of a print job onto print media sheets in a duplex printer having a sheet input, a duplex sheet recirculation path and a printed sheets output path, wherein the print job is being sent to the printer electronically from a remote user terminal, and wherein said print job contains print media sheet selection information, wherein said duplex printing of print media sheets has a normal first mode of duplex printing by recirculating said print media sheets after they are printed on their first sides through said printer duplex path of the printer for printing their second sides in said printer before feeding said print media sheets to said printed sheets output path, wherein said printer further includes a graphic user interface, a controller, and stored electronic information corresponding to pre-set print media sheet selections for which said normal first mode of duplex printing of print media sheets is undesirable for that printer, wherein, in response said receipt by said printer of a print job from said remote user terminal with said print media selection information corresponding to said pre-set print media sheet selections for which said normal first mode of duplex printing of print media sheets is undesirable for said printer, said printer automatically switches to a second and different mode of duplex printing in which said print media sheets are fed from said sheet input and printed on only one side and fed to said printed sheets output path bypassing said duplex sheet recirculation path and the portion of the print job for printing the other side of those print media sheets is temporarily stored in said printer controller and said printer graphic user interface automatically displays instructions to unload said printed sheets from said printed sheet output path and reload said printed sheets in said sheet input path in the proper orientation to print their opposite sides and the printing of said opposite sides is initiated from said printer graphic user interface rather than from said remote user terminal.

2. The dual mode printing method for duplex printing of print media sheets in a duplex printer of claim 1, wherein said printer graphic user interface automatically displays instructions to select said identified portion of said print job for second side printing from a displayed and tagged print job queue that corresponds to said opposite sides of said print media sheets that are printed on only one side.

3. The dual mode printing method for duplex printing of print media sheets in a duplex printer of claim 1, wherein said remote user electronically sent print media selection information corresponding to said pre-set print media sheet selections for which said normal first mode of duplex printing of print media sheets is undesirable for said printer comprise a selection of a heavyweight paper for a print job.

4. The dual mode printing method for duplex printing of print media sheets in a duplex printer of claim 1, wherein said pre-set print media sheet selections for which said normal first mode of duplex printing of print media sheets is undesirable for said printer comprises print media sheets basis weight related information, and wherein print media sheets basis weight information for the print media sheets presently loaded into the sheet input of said printer is additionally provided by an in-line sensor in said sheet input.

5. A duplex printer having a sheet input, a duplex sheet recirculation path and a printed sheets output path, and a dual mode duplex printing system for duplex printing of print media sheets, wherein said duplex printer has a normal first mode of duplex printing in which said print media sheets are printed on their first sides and then fed through said printer duplex sheet recirculation path for printing their second sides in said printer before feeding said print media sheets to said printed sheets output path, wherein said printer further includes a graphic user interface and a controller in which is stored electronic information corresponding to a pre-set maximum print media sheet weight for which said normal first mode of duplex printing is allowed for that printer, and an input for electronic information from a remote source corresponding to the desired weight of print media sheets selected for printing of a particular print job by a remote user, wherein in response said input of electronic information from said remote source corresponding to the a desired weight of print media sheets which exceeds said pre-set level of maximum print media sheet weight, said printer automatically switches to a second and different mode of duplex printing in which said print media sheets are fed from said sheet input and printed on only one side and fed to said printed sheets output path bypassing said duplex sheet recirculation path, and said printer graphic user interface automatically displays instructions to unload said printed sheets from said printed sheet output path and reload said printed sheets in said sheet input path to print their second sides, and the printing of said second sides by said printer may be fully initiated from said printer graphic user interface without requiring any electronic signals from any remote location.

6. The duplex printer of claim 5, wherein said graphic user interface automatically displays instructions to select a print job for said printing of said second sides from a displayed print job queue on said printer graphic user interface.

7. The duplex printer of claim 5, wherein said printer has an in-line sheet properties sensor in said sheet input providing additional electronic information corresponding the weight of print media sheets in said sheet input of said printer.

8. The duplex printer of claim 5, wherein said graphic user interface automatically displays instructions to unload the sheets printed on only one side and to reload them in the input path in the correct orientation to print their opposite sides with selected stored page images for their opposite sides stored in said printer controller.

* * * * *